United States Patent [19]

Gustavsson

[11] Patent Number: 4,776,245

[45] Date of Patent: Oct. 11, 1988

[54] READJUSTABLE PAIR OF PLIERS FOR MOUNTING CIRCLIPS

[75] Inventor: Arne Gustavsson, Tyresö , Sweden

[73] Assignee: Devex Industridetaljer AB, Enskede, Sweden

[21] Appl. No.: 57,753

[22] Filed: Jun. 3, 1987

[30] Foreign Application Priority Data

Jun. 6, 1986 [SE] Sweden ..... 8602558

[51] Int. Cl.[4] ..... B25B 7/12

[52] U.S. Cl. ..... 81/302; 29/229; 81/393; 81/486

[58] Field of Search ..... 81/485, 486, 300, 302, 81/DIG. 6, 385, 393; 29/225, 229

[56] References Cited

U.S. PATENT DOCUMENTS 1,122,165 12/1914 Schoening ..... 81/302

2,483,383 9/1949 Heimann et al. ..... 81/393

3,681,840 8/1972 Pool ..... 81/302 X

*Primary Examiner*—Debra Meislin

*Attorney, Agent, or Firm*—Herbert Dubno

[57] ABSTRACT

A readjustable pair of pliers for mounting circlips has a handle which with the aid of a sidewardly bent attachment part is pivotally connected to an intermediate member carrying a jaw with an engagement pin. A second jaw carrying an engagement pin is rigidly connected with a second handle defining therewith a rigid unit to which said intermediate member is pivotally attached. The attachment part is defined by a parallelepipedic block tightly fitting in a corresponding groove in the intermediate member. By swinging the second handle through 180° relative the intermediate member the mode of operation of the pair of pliers is altered in dependence on if a circlip for inner or for outer mounting has to be served.

17 Claims, 2 Drawing Sheets

READJUSTABLE PAIR OF PLIERS FOR MOUNTING CIRCLIPS

FIELD OF THE INVENTION

The invention relates to a readjustable pair of pliers for mounting circlips, i.e. slotted resilient retaining rings which are introduced, e.g. in order to fix a constructional part, into peripheral grooves either on the outer surface (e.g. in the case of a shaft) as outer retaining rings or on the inner surface (e.g. in the case of a bore) as inner retaining rings of a cylindrical configuration.

BACKGROUND OF THE INVENTION

Circlips are at both their ends provided with small openings in which, when the circlip is to be mounted or dismounted, engagement pins of a pair of pliers may be introduced in order to spread these ends (in circlips mounted on the outside of a cylindrical body) or to bring them closer together (in circlips mounted on the inside of a cylindrical opening).

To avoid the necessity of always having ready two different pairs of pliers, viz. one pair where the pins approach when the handles are moved closer together, and one pair where the pins spread farther apart when the handles are moved closer together, readjustable pairs of pliers have already been proposed in which both ways of operation can be obtained as actually needed.

One known pair of pliers of this kind comprises two jaws which at their ends are terminated by the engagement pins, and two handles of which each handle is rigidly connected with one of the jaws. The two rigid handle jaw units thus obtained are pivoted one to another with the aid of a pivot pin which is affixed to one of the units and which may be introduced into one of two holes adjacently arranged in the other unit. Depending on which hole is chosen, the engagement pins either approach one another or spread farther apart one from another, when the two handles are approached one to another.

OBJECT OF THE INVENTION

It is an object of the present invention to provide a pair of pliers for mounting circlips which offers a very simple possibility of readjusting one of the handles, and preferably locking it then in the selected position, thus defining one of the two modi operandi of the tool.

SUMMARY OF THE INVENTION

The invention provides to a readjustable pair of pliers for mounting circlips which comprises two jaws terminated at their free ends by pins engageable in holes provided to this purpose in the circlips, and two handles which are pivotably connected one with another for pivoting about a first pivot axis. A first of these handles is rigidly connected to the first of the jaws to define therewith a rigid unit. According to the present invention, the second handle is rigidly attached to an intermediate member which is pivotally connected to said rigid unit for pivoting about the first pivot axis, the second handle being with the aid of a sidewardly bent attachment part pivotally connected with the intermediate member for pivoting about a second pivot axis extending at right angles to the first pivot axis, whereby the attachment part may occupy relative said intermediate unit any one of two end positions differing from one from another by 180°.

BRIEF DESCRIPTION OF THE DRAWING

Further details about the pair of pliers of the present invention will be evident from the following description of an exemplary embodiment according to the enclosed diagrammatic drawing, in which.

SPECIFIC DESCRIPTION

Figure 1:
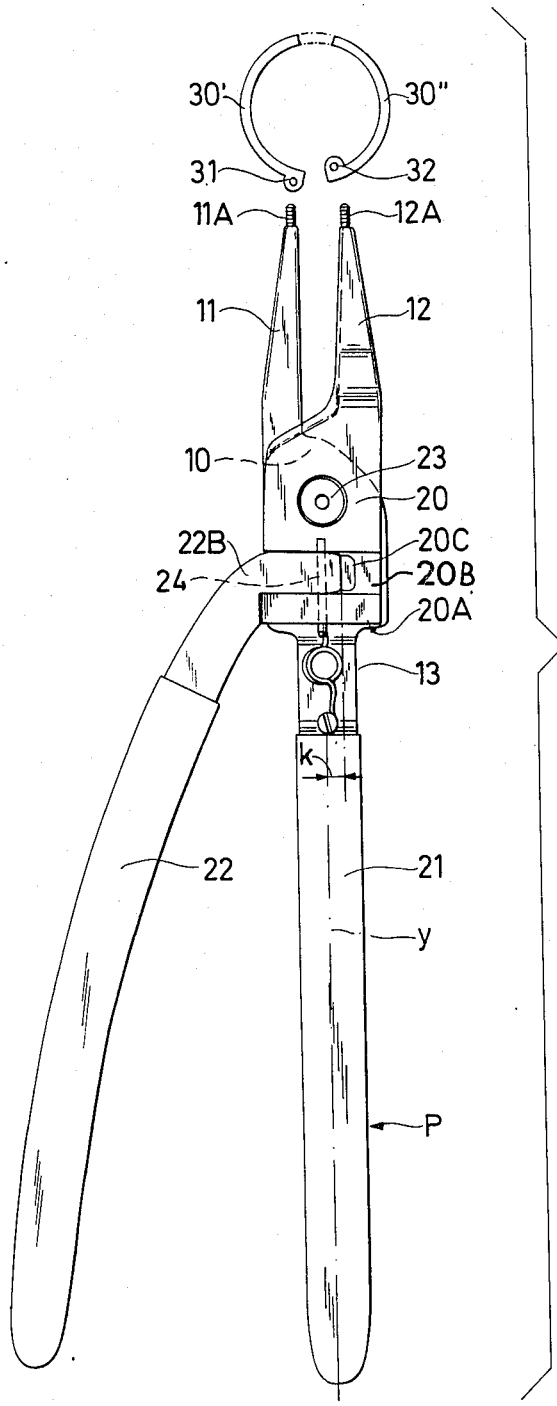
FIG. 1 is a plan view of a pair of pliers according to the present invention.
Figure 2:
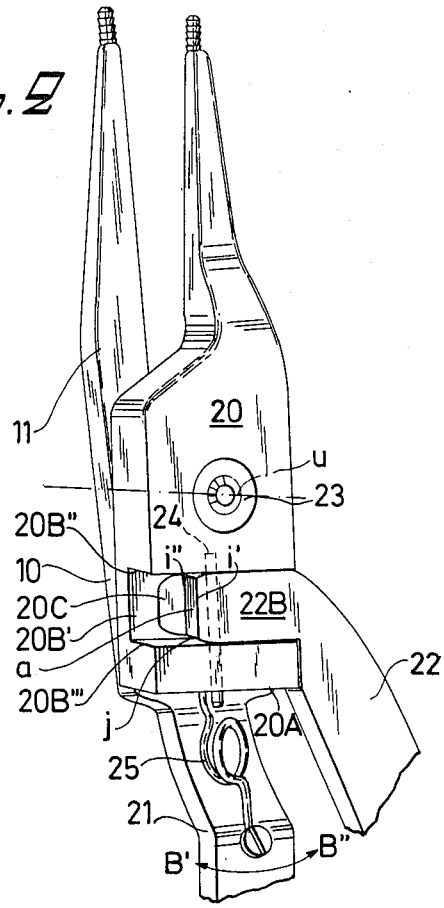
FIG. 2 is a perspective view, on a larger scale, of the operative part of the pair of pliers of FIG. 1.

The pair of pliers of FIGS. 1 and 2 comprises two jaws 11, 12 which may be moved toward and spread apart from one another and which are terminated by respective engagement pins 11A, 12A which may be introduced into holes 31, 32 provided to this purpose at both ends of a circlip. FIG. 1 is shows at the left one half of a circlip 30' for mounting in a groove on the outside of a cylindrical body (i.e. an external retaining ring), and at the right one half of a circlip 30'' for mounting in a groove in an inner surface of a cylindrical bore (i.e. an internal retaining ring). In practice, of course, both ends of either circlip are identical.

The first jaw 11 is with the aid of a first intermediate member 10 rigidly attached to a first handle 21 and defines therewith one single rigid construction unit 13. The first intermediate member 10 is from its lower part, as evident in FIG. 1, symmetrical relative to a length axis y.

The second jaw 12 is rigidly connected only to a second intermediate member 20 which, when both intermediate parts 10 and 20 cover one the other, is in its lower part also symmetrical about the said axis y.

The two intermediate members 10 and 20 are pivotally connected one to another by a pivot pin 23 for pivoting about a first pivot axis u. The intermediate member 20 has essentially the same shape as the intermediate member 10, but it terminates with a transverse edge 20A approximately at the location where on the first intermediate member 10 the handle 21 is rigidly attached.

The second handle 20 is bent to one side and has at its attachment end a deflected attachment part 22B having the shape of a parallelepipedic block, the front surface a (FIG. 2) of which is delimited by two lateral edges i' and i'' extending parallel with the said longitudinal axis y. The block defining the attachment part is in the direction of these side edges i', i'' longer than in the direction of an edge j extending at right angles to the edges i' and i''.

Figure 3:
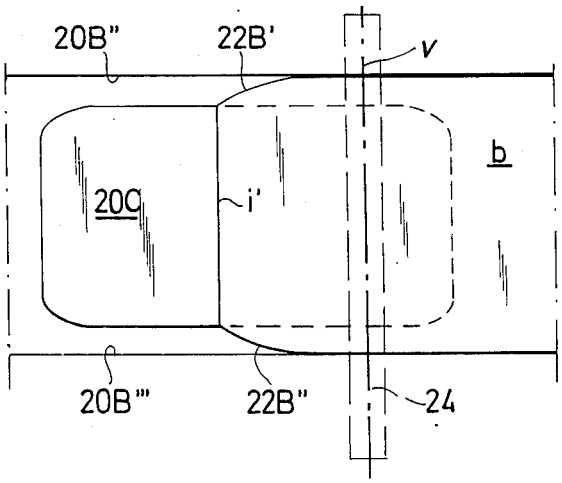
FIG. 3 is a plan view, on a still larger scale, of a detail of FIGS. 1 and 2.

A transverse groove 20B is arranged in the intermediate member 20 slightly beyond the transverse edge 20A. The groove 20B has a parallelepipedic shape congruent with the shape of the block 22B, but the groove 20B is somewhat longer than the block 22B. A leaf spring 20C is recessed in the bottom surface 20B' (FIG. 2) of the groove 20B by being located in a recess which also provides sufficient space at the rear of the spring (i.e. in the mass of the intermediate member 20) so that the central part of the spring may recede when it is affected by pressure. The leaf spring 20C has in the direction of the lateral edges i' and i'' on the block 22B at least the same dimension as these edges. However, the block 22B may slightly taper at its terminal part (as best seen at 22B and 22B" in FIG. 3), so that the edges i' and i" are somewhat shorter than the width of the groove 20B, and also the leaf spring 20C may be narrower to a corresponding degree. Due to said leaf spring 20C, the groove 20B has a bottom surface which is resilient at least in the region of the lateral edges i' or i" of the adjacent block 22B.

A pin 24, anchored in bores in the intermediate member 20 and passing through a bore in the attachment parts 22B, is arranged at half the length of the groove 20B, and the handle 22 is with the aid of this pin 24 pivotally attached to the intermediate member 20 for pivoting about a second pivot axis v extending at right angles to the first pivot axis u. The bores for the pin 24 are so located in the intermediate member 20 and in the block 22B that the pin 22 lies in the middle of the depth dimension (the dimension in the direction of the edge j) of the groove 20B and of the block 22B, and at the same distance k (FIG. 1) from the front surface a (FIG. 2) as from the bottom surface 20B' of the groove 20B comprising the recessed spring 20C.

The handle 22 is in FIG. 1 shown in the end position for serving circlips of the type 30"; when the handle 21 is pressed toward the handle 22 in the sense of arrow P, the pins 11*a*, 12*a* approach one other and the circlip is compressed.

For serving circlips of the type 30', the handle 22 is swung about the pin 22 through 180° into the end position shown in FIG. 2. During this motion, it is first the edge i' which presses the leaf spring 20C rearwardly and later, when the pivoting motion continues beyond 90°, the same occurs with the edge i". Due to the above mentioned congruent shape of the attachment part 22B and of the groove 20B, as well as due to the said location of the pivot pin 24, the handle 22 is locked in both its end positions shown in FIG. 1 and FIG. 2, because one of the lateral surfaces of the attachment part 22B (in FIG. 3 the rear lateral surface, not shown, which lies opposite the lateral surface b), always bears against the leaf spring 20C. A third locked position occurs when the block 22B during the pivotal movement attains said 90° position in which the front surface a bears against the leaf spring 20C, but this locking effect is irrelevant from the functional point of view. The desired locking or detent effect may be achieved also in some other manner, e.g. with the aid of a spring-loaded ball in the upper and/or lower surface 20B" or 20B"' of the groove 20B and a co-operating recess in the adjacent surface of the attachment part 22B. The leaf spring 20C may in this case be discarded and the front surface a of the attachment part may be shaped e.g. as a semi-cylinder.

A symmetrically operating spring 25, i.e. a spring having the same effect in both senses B' and B" (FIG. 1) is anchored on the second intermediate member 20 and on the first handle 21, allowing compression of the two handles 21, 22 and their return to the initial position irrespective of the side of the first handle 21 on which the second handle 22 is positioned. The spring 25 may also have some other shape and may be embodied e.g. by a straight leaf spring.

In principle, it is not necessary that also those surfaces of the attachment part 22B which are adjacent the said surface 20B" and 20B"' of the groove 20B be congruent with and bear against these last named surfaces. But if, as shown in the drawings, this is the case (with the exception of the short tapering terminal portions 22B' and 22B", FIG. 3), the considerable additional advantage is obtained that, in operation an important part of the transmission of force from the handle 22 to the intermediate member 20 takes place between the said surfaces of the block 22B and of the groove 20B, whereby the pivot pin 24 is considerably releaved from stress and consequently may be made rather thin. A rugged pin on the respective location would call for a thicker attachment part 22B and a deeper groove 20B, i.e. a more rugged overall construction of the whole pair of pliers.

I claim:

1. A convertible retaining ring plier, comprising:

a first jaw formed with an engaging pin adapted to enter a hole at an end of a retaining ring and with a first intermediate member rigid with said jaw;

a second jaw formed with an engaging pin adapted to enter a hole at another end of said retaining ring and rigidly connected to a second intermediate member;

means pivotally connecting said first and second intermediate members for mutual pivotal movement of said jaws to spread and approach said pins about a first pivot axis;

a first handle fixed to said first intermediate member; and a second handle pivotally connected to said second intermediate member for swinging movement about a second pivot axis at substantially a right angle to said first pivot axis whereby said second handle can be swung to lie on opposite sides of said first handle.

2. The convertible retaining ring plier defined in claim 1, further comprising resilient means acting upon said jaws upon said mutual pivotal movement for returning said jaws to an initial position.

3. The convertible retaining ring plier defined in claim 2 wherein said resilient means is a spring acting symmetrically upon said jaws in two opposite senses.

4. The convertible retaining ring plier defined in claim 1 wherein said first handle is substantially straight.

5. The convertible retaining ring plier defined in claim 1 wherein said second handle is connected to said second intermediate member by an attachment portion, said second intermediate member having a parallelepipedic groove receiving said attachment portion, said second axis being defined by a pivot pin passing through said attachment portion and anchored in said second intermediate member adjacent said groove.

6. The convertible retaining ring plier defined in claim 5 wherein said attachment portion has upper and lower surfaces which bear against adjacent surfaces of said groove whereby a part of force transmitted by said second handle to said second intermediate member is transmitted by said groove.

7. The convertible retaining ring plier defined in claim 5, further comprising means for locking said second handle selectively to opposite sides of said first handle.

8. The convertible retaining ring plier defined in claim 7 wherein said means for locking said second handle includes resilient means bearing upon said attachment portion.

9. The convertible retaining ring plier defined in claim 8 wherein said resilient means bearing upon said attachment portion is a leaf spring recessed in said groove.

10. A convertible retaining ring plier, comprising:

a first jaw formed with an engaging pin adapted to enter a hole at an end of a retaining ring and with a first intermediate member rigid with said jaw;

a second jaw formed with an engaging pin adapted to enter a hole at another end of said retaining ring and rigidly connected to a second intermediate member;

means pivotally connecting said first and second intermediate members for mutual pivotal movement of said jaws to spread and approach said pins about a first pivot axis;

a first handle fixed to said first intermediate member; and a second handle pivotally connected to said second intermediate member for swinging movement about a second pivot axis at substantially a right angle to said first pivot axis whereby said second handle can be swung to lie on opposite sides of said first handle in respective end positions, said second handle being connected to said second intermediate member by an attachment portion formed as a substantially parallelepipedic block, said second intermediate member having a parallelepipedic groove substantially congruent to and receiving said block, said groove being longer than said block, said second axis being defined by a pivot pin passing through said attachment portion and anchored in said second intermediate member adjacent said groove.

11. The convertible retaining ring plier defined in claim 10 wherein said attachment portion has upper and lower surfaces which in either of said end positions of said second handle bear against adjacent surfaces of said groove whereby a part of force transmitted by said second handle to said second intermediate member is transmitted by said groove.

12. The convertible retaining ring plier defined in claim 10, further comprising means for locking said second handle selectively in each of said end positions.

13. The convertible retaining ring plier defined in claim 12 wherein said means for locking said second handle includes resilient means bearing upon said block.

14. The convertible retaining ring plier defined in claim 13 wherein said resilient means bearing upon said block is a leaf spring recessed in said groove.

15. The convertible retaining ring plier defined in claim 10, further comprising resilient means acting upon said jaws upon said mutual pivotal movement for returning said jaws to an initial position.

16. The convertible retaining ring plier defined in claim 15 wherein said resilient means acting upon said jaws is a spring acting symmetrically upon said jaws in two opposite senses.

17. The convertible retaining ring plier defined in claim 10 wherein said first handle is substantially straight.

* * * * *